US007661202B2

(12) United States Patent
Han et al.

(10) Patent No.: US 7,661,202 B2
(45) Date of Patent: Feb. 16, 2010

(54) STRUCTURE OF MOTOR SHAFT IN CLOTHES DRYER

(75) Inventors: In Hee Han, Changwon-si (KR); Soo Won Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 447 days.

(21) Appl. No.: 10/660,732

(22) Filed: Sep. 12, 2003

(65) Prior Publication Data

US 2004/0221477 A1 Nov. 11, 2004

(30) Foreign Application Priority Data

Sep. 12, 2002 (KR) ..... 10-2002-0055460

(51) Int. Cl.
*F26B 11/02* (2006.01)

(52) U.S. Cl. ..... 34/595; 34/599; 34/601; 34/602; 34/604; 417/360

(58) Field of Classification Search ..... 34/595, 34/599, 601, 602, 604, 606; 417/360; 81/13
See application file for complete search history.

(56) References Cited

U.S. PATENT DOCUMENTS 1,130,383 A * 3/1915 Ellison ..... 118/102
1,564,896 A * 12/1925 Rinker et al. ..... 392/385
1,821,525 A * 9/1931 Nielsen ..... 392/385
2,165,487 A * 7/1939 Johnson ..... 68/18 C
2,181,436 A * 11/1939 Madden ..... 237/6
2,251,888 A * 8/1941 Leflar ..... 416/240
2,432,067 A * 12/1947 Morse ..... 392/385
2,547,238 A * 4/1951 Tremblay ..... 34/603
2,713,627 A * 7/1955 Kamataris ..... 392/383
2,776,640 A * 1/1957 Miklofsky et al. ..... 118/74
2,908,249 A * 10/1959 Rokosz et al. ..... 118/425
3,102,961 A * 9/1963 Kuehn, III ..... 290/37 R
3,211,890 A * 10/1965 Graves ..... 392/385
3,264,016 A * 8/1966 Reisch ..... 403/329
3,284,611 A * 11/1966 Laing ..... 392/384
3,391,670 A * 7/1968 Lester et al. ..... 118/666
3,832,112 A * 8/1974 Dye ..... 425/291
3,853,092 A * 12/1974 Amos et al. ..... 118/56
3,905,379 A * 9/1975 Churas et al. ..... 132/272
3,914,955 A * 10/1975 McCullough ..... 62/237
3,939,850 A * 2/1976 Wahl ..... 132/148
3,943,329 A * 3/1976 Hlavac ..... 392/379
3,981,314 A * 9/1976 Barradas ..... 132/118
4,092,952 A * 6/1978 Wilkie et al. ..... 118/58
4,135,080 A * 1/1979 Wells, Jr. ..... 392/385
4,232,454 A * 11/1980 Springer ..... 34/97
4,312,291 A * 1/1982 Knab ..... 118/50
4,339,743 A * 7/1982 Ludwig ..... 338/206

(Continued)

*Primary Examiner*—Stephen M. Gravini
(74) *Attorney, Agent, or Firm*—McKenna Long & Aldridge LLP

(57) ABSTRACT

The present invention relates to a clothes dryer, in which mounting/dismounting of a fan is made easy by clamping a motor shaft with a tool, such as a spanner, effectively in cases when the fan is dismounted/mounted from/on the motor shaft for service of the product. For this, a motor shaft structure, in a clothes dryer including a drying drum rotatably mounted in a body, a motor bracket fixed to a bottom of an inside of the body, a motor mounted on the motor bracket for generating a rotating power, and a fan coupled to the motor with a shaft, includes chambered parts.

1 Claim, 5 Drawing Sheets

U.S. PATENT DOCUMENTS 4,488,363 A * 12/1984 Jackson et al. ..... 34/572
4,593,179 A * 6/1986 Schulz et al. ..... 392/365
4,596,921 A * 6/1986 Hersh et al. ..... 392/385
4,674,621 A * 6/1987 Takahashi ..... 198/378
4,678,410 A * 7/1987 Kullen ..... 417/423.1
4,765,066 A * 8/1988 Yoon ..... 34/261
4,893,703 A * 1/1990 Kennedy et al. ..... 192/58.61
5,054,211 A * 10/1991 Shulman ..... 34/97
5,146,693 A * 9/1992 Dottor et al. ..... 34/77
5,161,317 A * 11/1992 McDougall ..... 34/97
5,187,879 A * 2/1993 Holst ..... 34/261
5,203,093 A * 4/1993 Baker ..... 34/601
5,317,815 A * 6/1994 Hwang ..... 34/97
5,341,578 A * 8/1994 Anderson ..... 34/97
5,392,528 A * 2/1995 McDougall ..... 34/97
5,463,821 A * 11/1995 Gauer ..... 34/261
5,471,763 A * 12/1995 McArthur ..... 34/96
5,555,647 A * 9/1996 Torborg et al. ..... 34/601
5,664,936 A * 9/1997 Cunha et al. ..... 416/204 R
5,700,346 A * 12/1997 Edwards ..... 156/357
5,841,943 A * 11/1998 Nosenchuck ..... 392/385
5,947,167 A * 9/1999 Bogen et al. ..... 141/1
5,983,520 A * 11/1999 Kim et al. ..... 34/261
6,076,583 A * 6/2000 Edwards ..... 156/539
6,096,271 A * 8/2000 Bogen et al. ..... 422/64
6,151,795 A * 11/2000 Hoffman et al. ..... 34/92
6,180,061 B1 * 1/2001 Bogen et al. ..... 422/64
6,183,693 B1 * 2/2001 Bogen et al. ..... 422/64
6,224,335 B1 * 5/2001 Parisi et al. ..... 415/206
6,236,630 B1 * 5/2001 Kubo et al. ..... 369/47.36
6,270,559 B1 * 8/2001 Daneshfar ..... 96/262
6,296,809 B1 * 10/2001 Richards et al. ..... 422/64
6,343,529 B1 * 2/2002 Pool ..... 81/13
6,387,326 B1 * 5/2002 Edwards et al. ..... 422/63
6,393,725 B1 * 5/2002 Smith et al. ..... 34/260
6,541,261 B1 * 4/2003 Bogen et al. ..... 436/46
6,582,962 B1 * 6/2003 Richards et al. ..... 436/46
6,585,936 B1 * 7/2003 Shah ..... 422/63
6,722,165 B2 * 4/2004 Woo et al. ..... 68/19.2
6,738,564 B1 * 5/2004 Tung ..... 392/385
6,746,215 B2 * 6/2004 Tani et al. ..... 417/366
6,751,886 B2 * 6/2004 Chang et al. ..... 34/96
6,756,015 B2 * 6/2004 Dalkidis et al. ..... 422/68.1
6,783,733 B2 * 8/2004 Bogen et al. ..... 422/64
6,827,900 B2 * 12/2004 Thiem et al. ..... 422/63
6,827,901 B2 * 12/2004 Copeland et al. ..... 422/64
6,874,248 B2 * 4/2005 Hong et al. ..... 34/239
6,922,909 B2 * 8/2005 Andrew et al. ..... 34/96
6,943,029 B2 * 9/2005 Copeland et al. ..... 436/46
6,957,500 B2 * 10/2005 McCambridge et al. ..... 34/96
6,966,124 B2 * 11/2005 Ryu ..... 34/134
6,966,125 B2 * 11/2005 Rago et al. ..... 34/283
7,021,088 B2 * 4/2006 Hong et al. ..... 68/20
7,039,301 B1 * 5/2006 Aisenberg et al. ..... 392/380
7,178,261 B2 * 2/2007 McCambridge et al. ..... 34/96
7,178,264 B2 * 2/2007 Kim ..... 34/596
7,188,437 B2 * 3/2007 Lee et al. ..... 34/595
7,217,392 B2 * 5/2007 Bogen et al. ..... 422/64
7,254,967 B2 * 8/2007 Kim et al. ..... 68/19.2
7,270,785 B1 * 9/2007 Lemme et al. ..... 422/64
7,296,443 B2 * 11/2007 Usherovich et al. ..... 68/3 R
7,302,815 B2 * 12/2007 Kim et al. ..... 68/18 C
7,303,725 B2 * 12/2007 Reinhardt et al. ..... 422/63
7,306,045 B1 * 12/2007 Moflihi ..... 169/70
7,350,319 B2 * 4/2008 Kim et al. ..... 34/603
7,367,201 B1 * 5/2008 Doring et al. ..... 62/419
7,378,055 B2 * 5/2008 Lemme et al. ..... 422/64
7,400,983 B2 * 7/2008 Feingold et al. ..... 702/31
7,404,927 B2 * 7/2008 Lemme et al. ..... 422/64
7,415,848 B2 * 8/2008 Jeong et al. ..... 68/18 C
7,425,306 B1 * 9/2008 Kram ..... 422/67
7,468,161 B2 * 12/2008 Reinhardt et al. ..... 422/63
7,470,541 B2 * 12/2008 Copeland et al. ..... 436/46
7,553,672 B2 * 6/2009 Bogen et al. ..... 436/46
D600,856 S * 9/2009 Robert ..... D28/54.1
2004/0221477 A1 * 11/2004 Han et al. ..... 34/601
2006/0048406 A1 * 3/2006 Kim et al. ..... 34/603

* cited by examiner

STRUCTURE OF MOTOR SHAFT IN CLOTHES DRYER

This application claims the benefit of Korean Application (s) No. P2002-0055460 filed on Sep. 12, 2002, which is/are hereby incorporated by reference.

BACKGROUND OF THE INVENTION

1. Field of the Invention

The present invention relates to clothes dryers, and more particularly, to an improved assembly structure of a shaft and a bracket of an idle pulley assembly that is a tension adjusting means in a clothes dryer.

2. Discussion of the Related Art

In general, the clothes dryer is an appliance for automatic drying of an drying object, such as washed wet clothes, of which related art system will be described.

FIG. 1 illustrates a longitudinal section showing a system of a related art clothes dryer, provided with a body 1 having an introduction opening 101 in a front surface, a drying drum 30 rotatably mounted in the body 1 having a plurality of ridges 30*a* on an inside circumferential surface, a door 105 for opening/closing the introduction opening 101 selectively, a motor 50 fixed to an inside of the body 1 for generating a rotating force, a rotation power transmission device for transmission of the rotation force from the motor 50 to the drying drum 30, hot air guiding flow passages 10*a* and 10*b* for guiding air flow to introduce external air into the drying drum 30 and discharge to an outside of the body 1, a heater 20 in the hot air guiding flow passage 10*a* for heating the air, and a fan 40 connected to the motor shaft 500 for generating a forced blowing power to draw the external air through the hot air guiding flow passage 10*a* and discharging to an outside of the body 1.

In the meantime, the drying drum 30 in the related art clothes dryer has a support shaft in rear thereof rotatably supported on the body 1, for being made rotatable upon receiving the rotation power of the motor 50 by means of the rotation power transmission device, wherein, by rotating the drying drum 30, entangling of the drying objects therein is prevented, and continuous movement of the drying objects in the drying drum 30 is made, to deliver the hot air supplied to an inside of the drying drum 30 uniformly, thereby improving drying performance.

The rotation power transmission device is provided with a driving pulley 52 connected to the driving shaft 51 of the motor 50, and a drum rotating belt 60 for coupling the driving pulley 52 and the drying drum 30, for transmission of the rotating power of the motor 50 to the drying drum 30 through the belt 60, to make the drying drum 30 rotatable.

In the meantime, for preventing the belt 60 from slipping at the time of movement of the drying drum 30, there is a tension adjusting means at one side of a motor bracket 53 for keeping application of a tension to the belt 60.

A clothes drying process of the related art clothes dryer will be described.

First, after introduction of the drying object into the drying drum 30, a drying cycle is carried out, to put the heater 20 and the motor 50 into operation.

Then, as the fan 40 is operated, the external air introduced into the body 1 through an inlet of the hot air guiding flow passage 10*a* passes, and heated at, the heater 20, and flows into the drying drum 30 through the hot air guiding flow passage 10*a*, forcibly.

Then, the hot air introduced into the drying drum 30 repeats circulation in which the hot air vaporizes moisture in the wet drying objects, and is discharged to the outside of the body 1 through an outlet of the hot air guiding flow passage 10*b* by a suction blowing power of the fan 40, when the drying drum 30 rotates slowly as the drying drum 30 receives the driving power of the motor 50 through the belt 60, to lift and drop the drying objects therein with the ridges 30*a*, during which process, the drying objects are dried.

However, the related art clothes dryer has the following problems when it is intended to dismount the fan 40 from the motor 50 for service.

In a case when it is intended to dismount the fan 40 from the motor 50 for service, such as repair, or change of a component, it is required to unfasten a nut 'N' that fastens the fan 40 to the motor shaft 500, to do which the motor shaft 500 is required not to move.

That is, since unfastening of the nut 'N' is difficult if the motor shaft 500 moves, it is required to hold the motor shaft 500 for preventing the motor shaft 500 from moving.

However, since the related art motor shaft 500 has a circular section, clamping of the motor shaft 500 with a tool, such as a spanner, is difficult, resulting in a poor workability in dismounting the fan 40.

Moreover, when the nut 'N' is fastened for mounting the fan 40 on the motor shaft 500 after finish of the service, the fastening of the nut 'N' is not easy as the motor 500 shaft turns together with the nut 'N'.

SUMMARY OF THE INVENTION

An object of the present invention, devised to solve the related art problem, lies on improvement of workability by making the motor shaft able to be held in dismounting the fan from the motor shaft of clothes dryer for preventing the motor shaft from moving.

To achieve the object of the present invention, the present invention suggests providing a motor shaft structure in a clothes dryer having a drying drum rotatably mounted in a body, a motor bracket fixed to a bottom of an inside of the body, a motor mounted on the motor bracket for generating a rotating power, and a fan coupled to the motor with a shaft, includes chambered parts.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Figure 1:
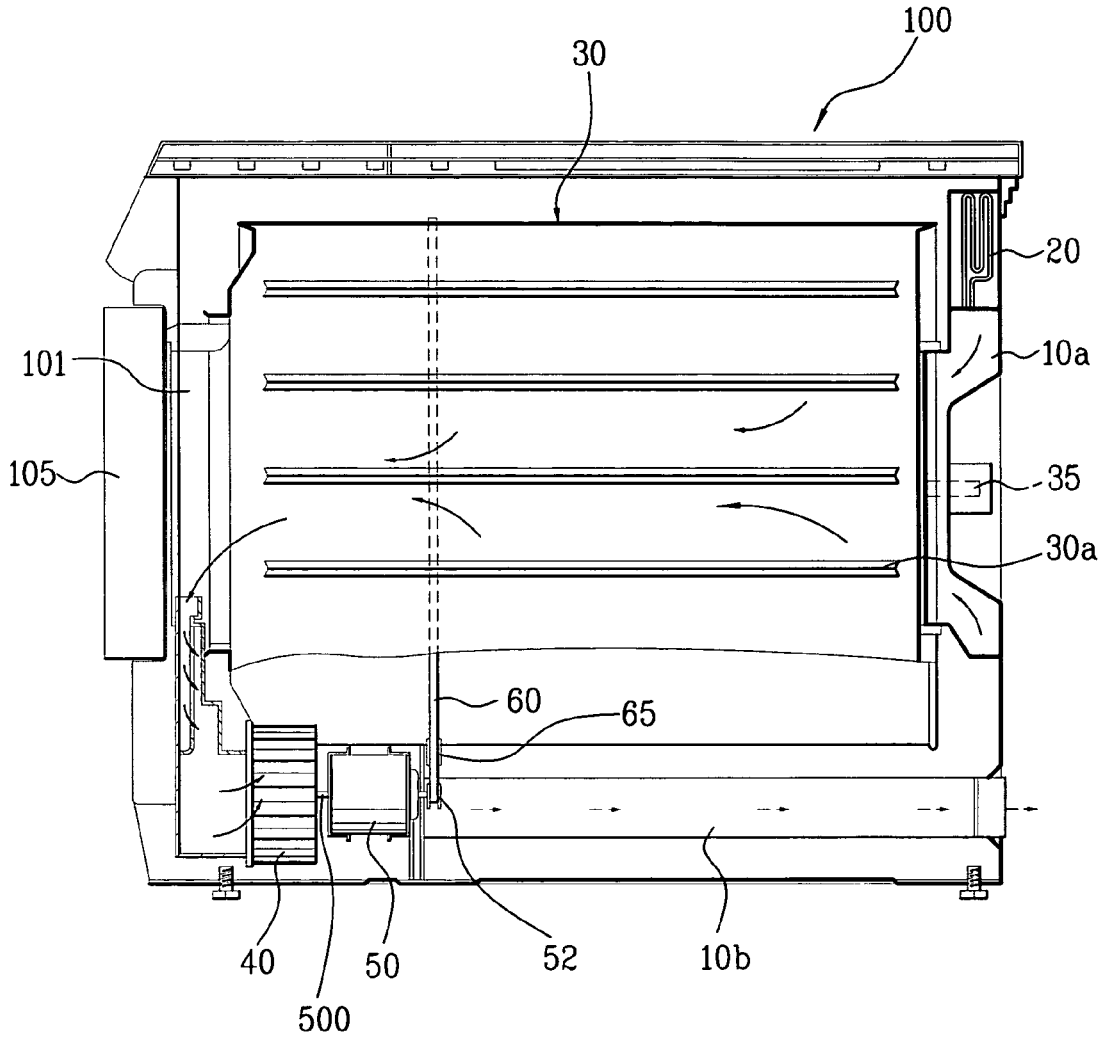
FIG. 1 Prior Art
FIG. 1 illustrates a longitudinal section showing a system of a related art clothes dryer.
Figure 2:
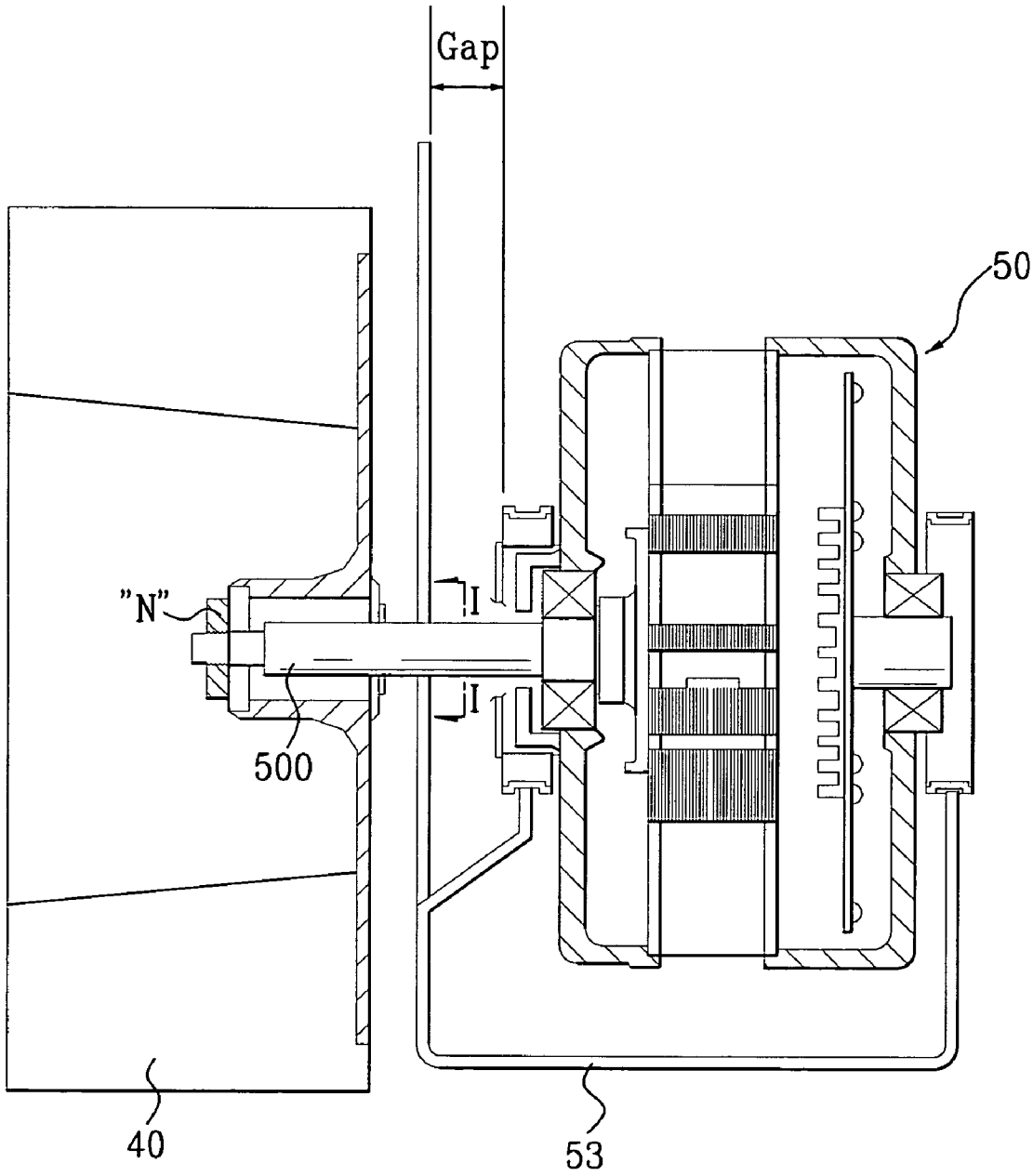
FIG. 2 Prior Art
FIG. 2 illustrates a detail of key parts of FIG. 1.
Figure 3:
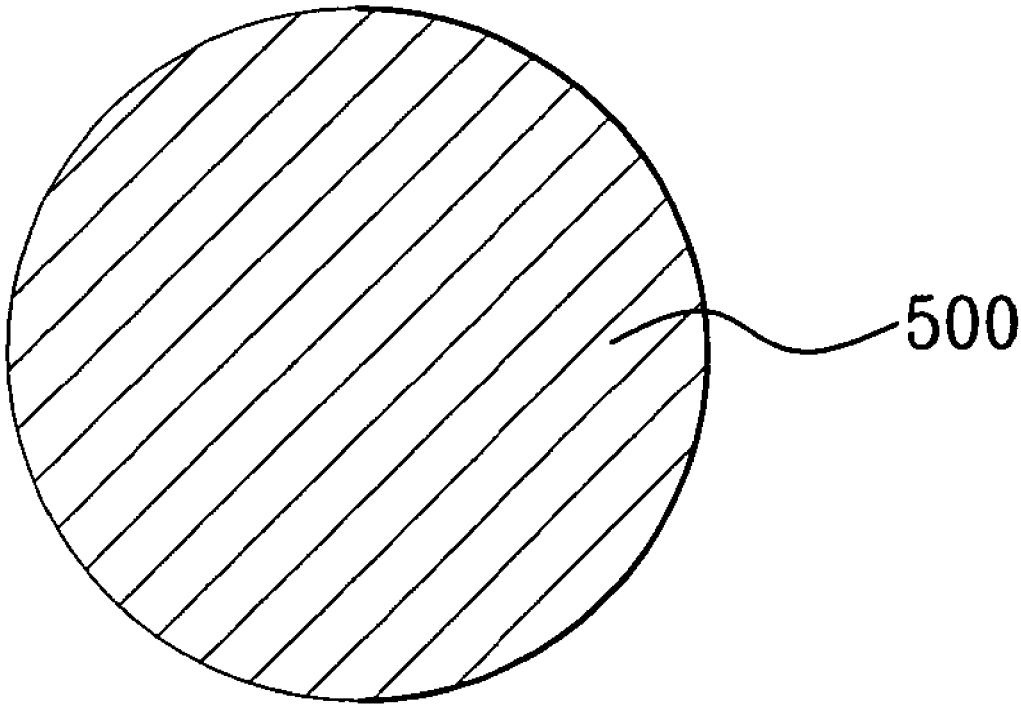
FIG. 3 Prior Art
FIG. 3 illustrates a section of a motor shaft across a line I-I in FIG. 2.
Figure 4:
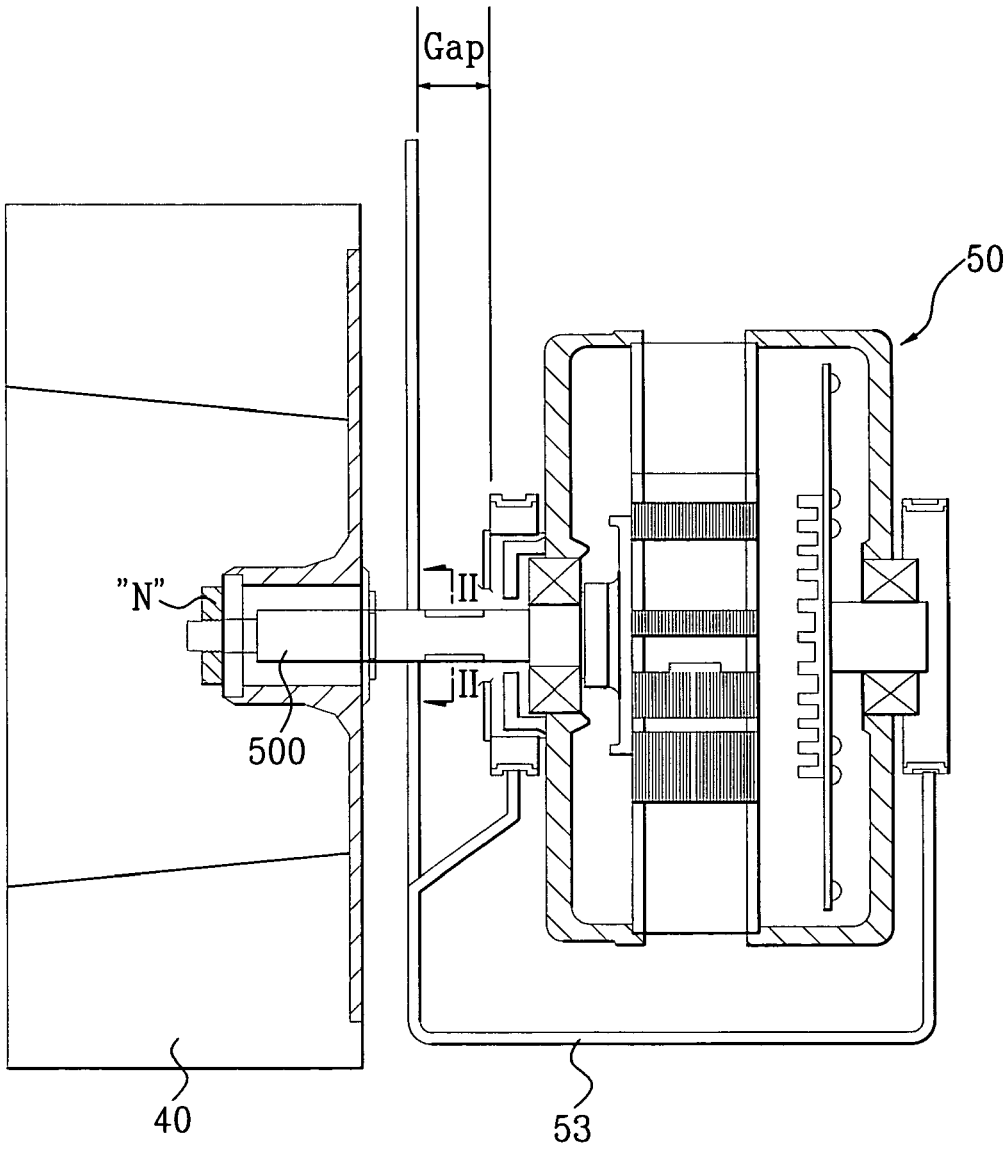
FIG. 4 illustrates a longitudinal section showing technical key parts of the present invention.

Reference will now be made in detail to the preferred embodiment(s) of the present invention, examples of which are illustrated in the accompanying drawings. Throughout the drawings, like elements are indicated using the same or similar reference designations where possible.

A preferred embodiment of the present invention will be described in more detail with reference to FIGS. 6~8.

In the following description, parts identical to the related art will be given the same reference numerals, and detailed description of which will be omitted.

Figure 5:
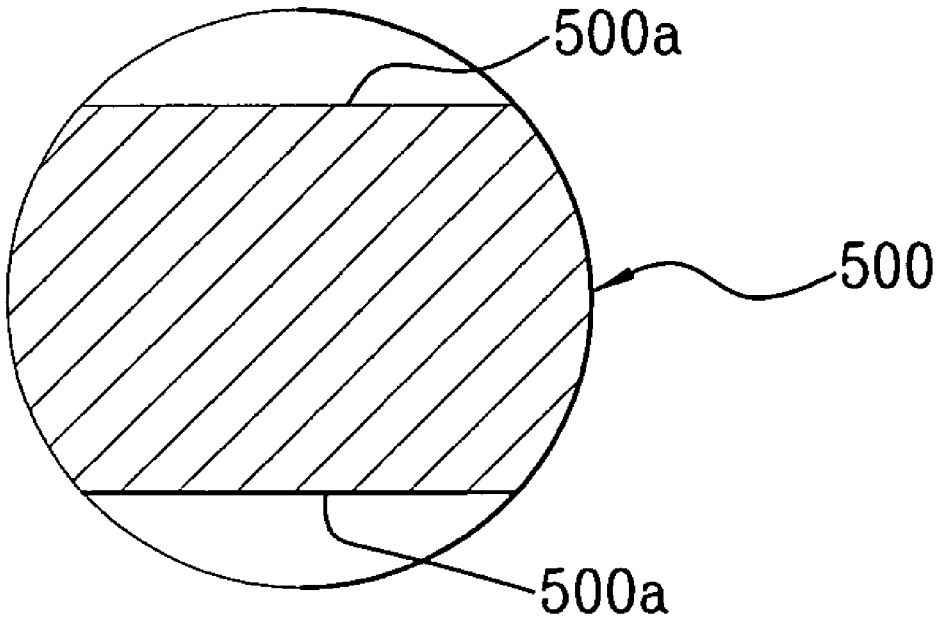
FIG. 5 illustrates a section of a motor shaft across a line II-II in FIG. 3.

FIG. 6 illustrates a front view of an idle pulley assembly of the present invention, FIG. 7 illustrates a longitudinal section across a line II-II in FIG. 5, and FIG. 8 illustrates a front view of an idle shaft inserting hole in an idle bracket of the present invention, wherein the present invention suggests providing a motor shaft structure in a clothes dryer having a drying drum 30 rotatably mounted in a body 1, a motor bracket 53 fixed to a bottom of an inside of the body 1, a motor 50 mounted on the motor bracket 53 for generating a rotating power, and a fan 40 coupled to the motor 50 with a shaft, includes chambered parts 500*a*.

In the meantime, the chamfered part 500*a* in the shaft 500 of the motor 50 has a D-cut form.

The operation of the present invention will be described.

When it is intended to dismount the fan 40 from the motor 50 for service, it is required to unfasten the nut 'N' that fastens the fan 40 to the motor shaft 500, for which the motor shaft 500 is required to be held.

In this instance, since the motor shaft 500 of the present invention has the chamfered parts 500*a* in the shaft, the chamfered parts 500*a* can be clamped with a tool, such as a spanner, to prevent the motor shaft 500 from turning, thereby making the unfastening of the nut 'N' easy.

That is, in the case of the present invention, the tool, such as the spanner, is inserted into a gap between the motor bracket 53, to clamp the chamfered parts 500*a* of the motor shaft 500, and unfasten the nut 'N' in a state the motor shaft 500 is prevented from moving.

In the meantime, even in mounting the fan 40 on the motor shaft 500, by clamping the chamfered parts 500*a* with the spanner, to prevent the nut 'N' from moving, fastening of the nut 'N' can be carried out with easy.

Even though it is preferable that the chambered parts 500*a* at one side of the motor shaft 500 have D-cut forms, the form is not limited to this.

Accordingly, the present invention has the following advantages or effects.

As has been described, the present invention improves a motor shaft structure of a clothes dryer, to improve workability in mounting/dismounting a fan.

That is, by making clamping of the motor shaft easy, to make, not only the unfastening of the nut for dismounting the fan, but also fastening of the nut for mounting the fan easy, the present invention improves workability.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A laundry dryer comprising:

a motor bracket fixed to a bottom of the dryer;

a motor mounted on the motor bracket, the motor including a motor shaft extending therefrom; and a fan coupled with the motor shaft, wherein the motor shaft includes chamfers parallel to each other and configured for facilitating removal of the fan from the motor shaft.

* * * * *